US007717106B2

(12) United States Patent
Has et al.

(10) Patent No.: US 7,717,106 B2
(45) Date of Patent: May 18, 2010

(54) BAKING OVEN

(75) Inventors: Uwe Has, Unterneukirchen (DE); Hans Lappat, Garching a.d. Alz (DE); Helmut Uglorz, Steinheim (DE); Michael Ulmer, Traunreut (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 572 days.

(21) Appl. No.: 10/898,599

(22) Filed: Jul. 23, 2004

(65) Prior Publication Data

US 2005/0011511 A1 Jan. 20, 2005

Related U.S. Application Data

(63) Continuation of application No. PCT/EP03/00511, filed on Jan. 20, 2003.

(30) Foreign Application Priority Data

Jan. 23, 2002 (DE) ..... 102 02 492

(51) Int. Cl.
*F24C 15/10* (2006.01)
*F24C 15/32* (2006.01)

(52) U.S. Cl. ..... 126/213; 126/273 R; 126/19 R; 219/385; 219/391

(58) Field of Classification Search ..... 126/273 R, 126/213, 19 R, 39 BA; 362/92, 94; 219/758, 219/220, 391, 393, 385, 411, 386, 387, 405, 219/214; 392/416, 411; 99/389
See application file for complete search history.

(56) References Cited

U.S. PATENT DOCUMENTS

| | | | | |
|---|---|---|---|---|
| 4,516,007 | A | 5/1985 | Ringdahl et al. | |
| 5,072,154 | A * | 12/1991 | Chen | 315/82 |
| 5,676,459 | A * | 10/1997 | Bedford et al. | 362/390 |
| 5,767,493 | A * | 6/1998 | Lautenschlager | 219/723 |
| 5,903,105 | A * | 5/1999 | Lee et al. | 315/84 |
| 5,909,950 | A * | 6/1999 | Seok et al. | 362/94 |
| 6,087,643 | A * | 7/2000 | Park | 219/702 |
| 6,501,237 | B2 * | 12/2002 | Davies | 315/362 |
| 6,892,723 | B2 * | 5/2005 | Anschutz et al. | 126/273 R |
| 6,951,402 | B1 * | 10/2005 | Copp | 362/94 |
| 7,030,349 | B1 * | 4/2006 | Graves et al. | 219/758 |
| 2003/0131841 | A1 | 7/2003 | Anschutz et al. | |

FOREIGN PATENT DOCUMENTS

| | | | |
|---|---|---|---|
| JP | 404163883 A | * | 6/1992 |
| JP | 05238309 A | * | 9/1993 |
| WO | WO 00/52392 | * | 9/2000 |

* cited by examiner

*Primary Examiner*—Kenneth B Rinehart
*Assistant Examiner*—Chuka C Ndubizu
(74) *Attorney, Agent, or Firm*—James E. Howard; Andre Pallapies

(57) ABSTRACT

A baking oven containing a lighting device for lighting the cooking area and a lighting control device for controlling the on/off states and time profiles of the lighting device. The lighting control device has at least two pre-determined time profiles for determining the lighting intensity of the lighting device according to the operation leading to the switching on of the lighting device.

15 Claims, 2 Drawing Sheets

BAKING OVEN

Figure 1:
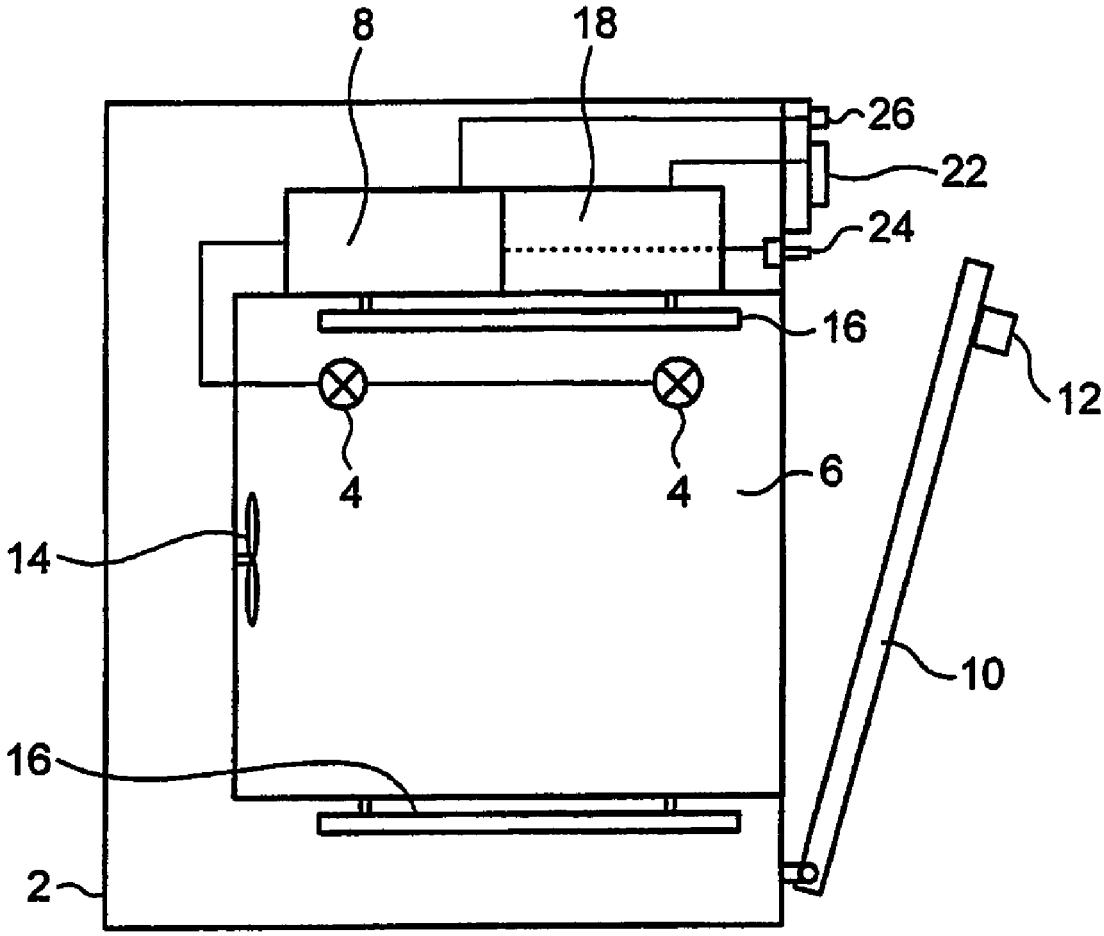

The invention relates to a baking oven having a lighting device for lighting a cooking area.

Such baking ovens are generally known.

Furthermore, U.S. Pat. No. 5,909,950 shows a refrigerator door handle which carries a contact sensor which, when touched by a user, switches on an interior lamp in the refrigerator. The interior lamp is controlled by a switch which recognises whether the door is open or closed. The lamp remains switched on until the refrigerator door is closed again.

The object to be solved by the invention is to construct the lighting of the cooking area such that it is more versatile in use.

This object is solved according to the invention by the features of claim 1.

The invention thus especially relates to a baking oven having a lighting device for lighting a cooking area and having a lighting control device for switching on, holding the switched-on state and switching off the lighting device in accordance with a pre-determined time profile which defines the increasing, holding and reducing of the lighting intensity, characterised in that the lighting control device has at least two different time profiles for increasing, holding and reducing the lighting intensity, and that the time profile to be respectively used by the lighting control device depends on the type of operation leading to the switching on of the lighting device.

As a result of the design of a lighting device for cooking areas of baking ovens according to the invention, the times for increasing, holding and reducing the lighting intensity can be varied in such a way that the respective times depend on the type of operation leading to switching on the lighting.

Thus, when switched on by a door switch, the lighting can be increased very rapidly, e.g. if good lighting is desired immediately on opening the cooking area door. Furthermore, the light can be held at a maximum lighting intensity for a very long time because, for example, when the door is opened for a longer time, the user presumably would like to handle the food being cooked in the cooking area or clean the cooking area and requires continuous lighting for this. After the holding time has elapsed, the lighting intensity can be reduced very slowly again and it can thereby be indicated to the user that the lighting device is not switched off by a fault but automatically in the correct fashion. A slow or very slow increase in the lighting intensity and a slow or very slow reduction of the lighting intensity means that the increase and/or reduction in the lighting intensity takes place along a lighting intensity time ramp of a time profile (diagram curve). In the event of a fast change in the lighting intensity, the ramp is steep. A very fast change means an abrupt rise or an abrupt fall in the lighting intensity, instead of over a lighting intensity time ramp.

According to a further embodiment of the present invention, instead of this or at the same time, for another type of usage it can be provided that after a brief contact of the door handle, the lighting intensity is increased moderately fast (ramp) to a maximum brightness, held there for a short time and then reduced rapidly again (steep ramp or sudden reduction in lighting intensity without ramp). In this case the customer presumably merely wishes to look briefly through a door window into the cooking area of the baking oven to check on the progress of the cooking process in the cooking area.

In the same or another embodiment it can furthermore be provided that when operating the baking oven using a function switch, an individual time profile is provided which optimally corresponds to the time profile pre-determined via the function switch. For example, a certain cooking process of the food to be cooked can be switched on by the function switch of the baking oven wherein the lighting of the cooking area is automatically switched on according to a time profile matched to this cooking process, the lighting intensity is increased, held and reduced again on switching off.

According to a further feature of the invention, it can be provided that the lighting is not increased to maximum brightness respectively suitable for the application. Instead, the brightness is left at a lower brightness, e.g. for permanent lighting of the cooking area, in order to display certain operating states to the customer. For example, the lighting intensity of the cooking area lighting can remain automatically switched on at the lower lighting intensity during the entire cooking process in order to make the food being cooked better visible to the user through the cooking area window and thereby also signal to said user than the cooking process in the cooking area is proceeding correctly.

The advantage of the invention: a cooking area lighting individually matched to the respective type of operation can be offered to the customer.

Further features of the invention are contained in the dependent claims:

Accordingly, a particular embodiment of the invention consists in the fact that at least two different time profiles are provided which have differences in the increasing of the lighting intensity from a minimum value to a maximum. A further embodiment of the invention consists in the fact that at least two different time profiles are provided which have differences in the reducing of the lighting intensity from a maximum value to a minimum.

A further embodiment of the invention consists in the fact that at least two different time profiles are provided which have differences in the holding of the lighting intensity.

A further embodiment of the invention consists in the fact that the time profiles have differences in the rising ramp of the increase and/or in the falling ramp of the decrease and/or in the value of the lighting intensity in the increased and/or in the reduced state.

A further embodiment of the invention consists in the fact that a door opening signal element is provided to signal an opening of the cooking area door to the lighting control device, wherein the door opening signal element is an element which can be actuated by the cooking area door depending on the door position or an element of a door handle of the cooking area door, which can be actuated manually to open the cooking area door.

A further embodiment of the invention consists in the fact that the lighting control device is constructed to switch on the lighting device on receiving a door-opening signal from the door opening signal element, which signals an opening of the cooking area door, and hereby increase the lighting intensity from a minimum value to a maximum value at a fast or very fast speed. A further embodiment of the invention consists in the fact that the lighting control device is constructed to reduce the lighting intensity from the maximum value to a minimum value after a pre-determined holding time during which the lighting intensity was held at a maximum value after switching on the lighting device, wherein the holding time begins on reaching the maximum value when switching on and runs automatically if the cooking area door is not opened during this holding time but does not run if the cooking area door is opened during the holding time in which case the holding time is automatically started again by the lighting control device after subsequently closing the cooking area door.

A further embodiment of the invention consists in the fact that the lighting control device is constructed to reduce the lighting intensity from the maximum value to the minimum value at a very slow or slow second speed depending on a lighting intensity time ramp of the time profile.

A further embodiment of the invention consists in the fact that the lighting control device is constructed to distinguish whether in one case the door handle signal element is actuated manually for a pre-determined long first minimum time as a sign for an opening of the cooking area door or in the other case, the door handle signal element was actuated manually only for a pre-determined short second minimum time as a sign that a person wishes to switch on the lighting device of the cooking area without opening the cooking area door, wherein in one case the lighting intensity is increased at a fast or very fast speed with a steep rising ramp or abruptly and the lighting intensity is reduced on switching off the lighting device at a slow or very slow speed with a flat descending ramp of the time profile, but in the other case the lighting intensity is increased from a minimum value to a maximum value at a moderate or fast speed on a rising ramp or suddenly, is then held for a short minimum time at the maximum value and is then reduced at a fast speed on a ramp or abruptly from the maximum value to the minimum value again.

A further embodiment of the invention consists in the fact that for at least one or a plurality of function switches at which respectively one cooking area heating function can be switched on by a person, the lighting control device has its own time profile for increasing, holding and reducing the lighting intensity of the lighting device of the cooking area, according to which when the function switch is actuated, the cooking area lighting is automatically switched on, increased, held at a maximum value for a pre-determined time and then reduced again and switched off.

A further embodiment of the invention consists in the fact that the time profiles are stored in the lighting control device or are pre-defined by an electronic circuit or can be generated by the lighting control device using a computer program depending on the type of operation by which the lighting device of the cooking area is switched on.

A further embodiment of the invention consists in the fact that the door opening signal element of the door handle is a contact sensor which responds to manual contact.

A further embodiment of the invention consists in the fact that at least one of the time profiles has a lighting intensity time increasing ramp for increasing and/or a lighting intensity time ramp for reducing the lighting intensity.

A further embodiment of the invention consists in the fact that at least one time profile is provided according to which the lighting intensity is held at a lower value compared with the maximum, which lies above zero, for permanent lighting in the cooking area.

Figure 2:
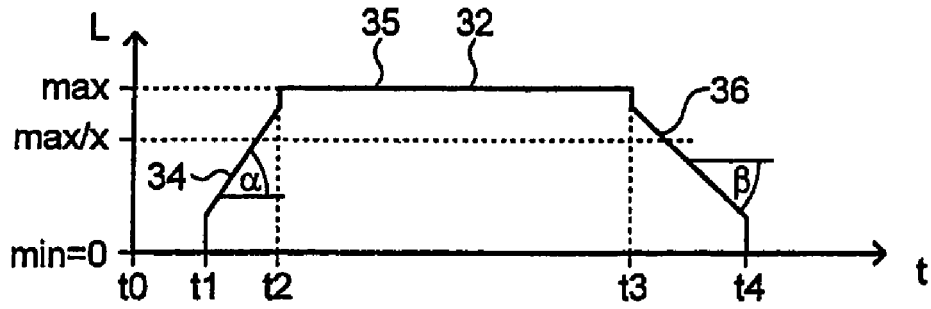
Figure 3:
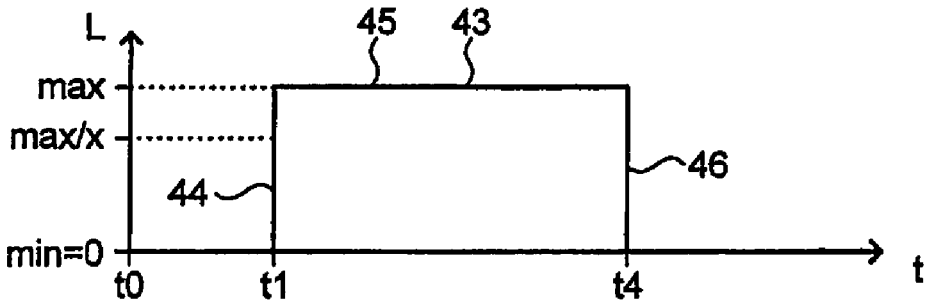
Figure 4:
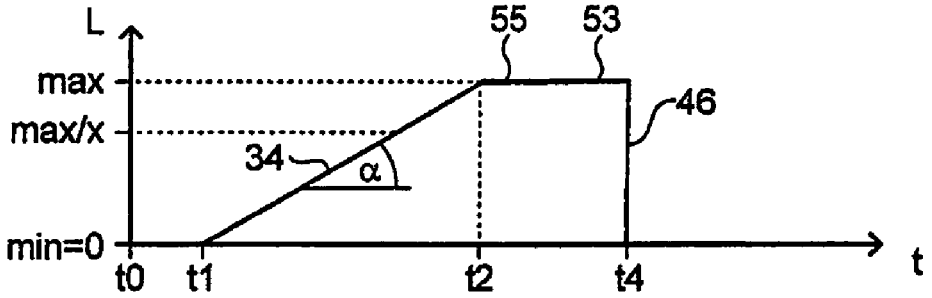
Figure 5:
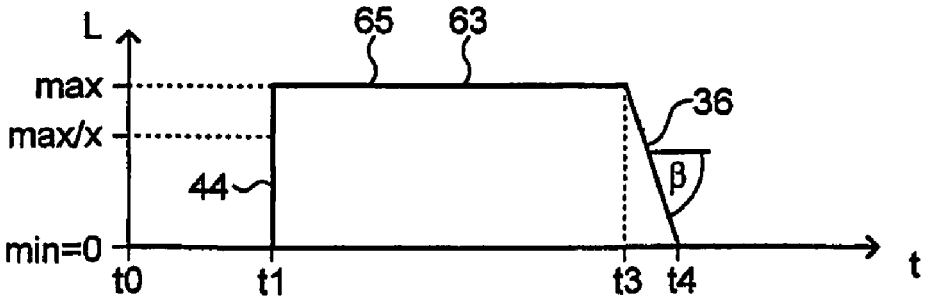

The invention is explained below with reference to the drawings using preferred embodiments as examples. In the figures FIG. 1 is a schematic diagram showing a vertical cross-section through a baking oven according to the invention, FIG. 2 is a time profile diagram, FIG. 3 is another time profile diagram, FIG. 4 is yet another time profile diagram and FIG. 5 is yet another time profile diagram, as examples of time profiles of which at least two different time profiles according to the invention are used by a user depending on the type of operation of the baking oven.

The baking oven 2 according to the invention shown in FIG. 1 can be an electric baking oven or a gas baking oven in the form of an independent appliance or a built-in appliance for building into a household appliance or into kitchen furniture.

The baking oven 2 contains a lighting device 4 for lighting a cooking area 6 and a lighting control device 8 for switching on, holding the switched-on state and switching off the lighting device 4 according to a pre-determined time profile. The time profile defines the increasing, holding and reducing of the lighting intensity.

The baking oven 2 furthermore contains a cooking area door 10 with a door handle 12, a fan 14 and an electric or gas-operated heating device 16 for heating the cooking area 6 under the control of a baking oven control device 18.

The baking oven control system 18 and the lighting control device 8 can be two separate devices or jointly one combined device.

At one or a plurality of function switches 22, respectively one of a plurality of cooking programs can be selected at the baking oven control device 18 for cooking food to be cooked in the cooking area 6. The cooking area can be constructed for baking, roasting, grilling, heating or otherwise treating food to be cooked. Corresponding cooking programs can be switched on by means of the function switch 22 on the baking oven control device. The function switch 22 can be a rotatable or rotary pluggable toggle or a contact sensor. Different time profiles can be provided for each cooking program or for groups of cooking programs. These can be matched to the cooking processes and thereby show the user in which operating situation the cooking area is.

A switch 24 on the baking oven body can be actuated by the cooking area door 10 when said cooking area door 10 is opened and closed. The switch 24 notifies the lighting control device 8 respectively when the cooking area door 10 is opened or closed and when it is open or shut.

At the same time or alternatively, the door handle 12 or a part thereof can be constructed as a switch or contact sensor which notifies the lighting control device 8 respectively whether manual contact takes place for a short time or longer.

The lighting control device 8 has at least two different time profiles for increasing, holding and reducing the lighting intensity of the lighting device 4 in the cooking area 6. The time profile to be used in each case by the lighting control device 8 depends on the "type of operation" which resulted in switching on the lighting device.

Examples for "types of operation" are: opening the cooking area door 10; closing the cooking area door 10 again after a short opening time; closing the cooking area door 10 again after a longer opening time; brief contact of the door handle 12 to thereby signal to the lighting control device 8 that a brief switch-on of the lighting device 4 without opening the cooking area door 10 is desired wherein the door handle is a switch or contact sensor which signals a manual contact of the lighting control device; a longer manual contact of the door handle 12 relative thereto (and if necessary opening of the cooking area door 10) to thereby signal to the lighting control device 8 that the cooking area door 10 will be opened or has just been opened, wherein the door handle is a switch or contact sensor which signals a manual contact of the lighting control device; actuating the function switch 22 in order to select or switch on a desired cooking program at the baking oven control device 18; actuating a lighting switch or lighting sensor 26 as a function element at which a user can adjust the lighting device 4 by means of the lighting control device 8 regardless of whether the cooking area door 10 is in the closed or open position. This is merely a list of examples and does not exclude other "types of operation" to which, according to the invention, a specific time profile is respectively assigned for increasing, holding and reducing the lighting intensity when switching on, holding and switching off the lighting device 4.

FIGS. 2 to 5 show examples of various time profiles of which one time profile each can be assigned to a particular type of operation.

The time profiles in FIGS. 2 to 5 show the time on the abscissa and the lighting intensity on the ordinate. In this case, it was assumed that when switching on, the lighting device is in each case switched on from zero (min=0) to a maximum value (max) of the lighting intensity (brightness). According to the invention, however it is also possible to have time profiles by which, for example for a permanent lighting state during the cooking process in the cooking area 6, the lighting device 4 is switched on to a reduced lighting intensity "max/x".

FIG. 2 shows a time profile 32 according to which the lighting device 4 is switched on at the time t1, but in this case the lighting intensity does not increase abruptly to the maximum value max but according to a lighting intensity time ramp 34 with an angle of inclination α. The maximum lighting intensity is reached at the time t2 and then maintained until the time t3 which is represented by a time profile section 35. At the time t3 the lighting device 4 is switched off wherein the lighting intensity is not switched off abruptly but is slowly shut down according to a descending ramp 36 at an angle β until the next time t4.

FIG. 3 shows another time profile 43 according to which the lighting device 4 is abruptly switched on at maximum lighting intensity at the time t1 and abruptly switched off to zero at the time t4. As a result, a vertical ascending flank 44 is obtained, then a horizontal time profile section 45 and then a vertical descending flank 46.

FIG. 4 shows a time profile 53 with an ascending ramp 34 the same as or different to that in FIG. 2 and an abruptly descending switch-off flank 46 according to FIG. 3 and a time profile section 55 running horizontally between the times t2 and t4.

FIG. 5 shows a time profile 63 with a switch-on flank 44 which rises abruptly from zero to the maximum value at time t1 in accordance with FIG. 3, then a horizontal time profile section 65 as far as the time t3, and then a descending time profile ramp 36 with an angle of descent β the same as or different to that in FIG. 2.

Further time profiles can for example consist in the fact that the ascending and/or the descending time profile section runs convexly or concavely instead of rectilinearly and/or the horizontal section 35 or 45 or 55 or 65 in FIGS. 2 to 5 is missing, with the maximum lighting intensity (max) being reduced again immediately after reaching said intensity so that a ramp-shaped increase in the lighting intensity (e.g. ramp 34 in FIG. 2 or FIG. 4) is followed by a ramp-shaped reduction of the lighting intensity (e.g. time profile section 36 in FIGS. 2 and 5) or a sudden switch-off and thus a vertical time profile section 46 in accordance with FIGS. 3 and 4. Similarly, it is possible to have a time profile in which a vertical increasing time profile section in accordance with 44 in FIGS. 3 and 5 is followed by a ramp-shaped decreasing section (e.g. ramp 36 in FIGS. 2 and 5).

The ramp angles α and/or β can be the same or different in all time profiles.

The "maximum values" specified in the description and in the claims can correspond to the highest permissible electrical current intensities of the lighting device or lower values. The "minimum values" specified in the description and in the claims preferably mean "completely switched off" and thus zero lighting intensity but can however also mean a low lighting intensity having an above-zero value.

The invention claimed is:

1. A baking oven, comprising:

a cooking area including a door in an opening of said cooking area;

said door including a handle to open and close said door;

a lighting device for lighting said cooking area producing a lighting intensity;

a lighting control device coupled to said lighting device for switching on, holding the switched-on state and switching off said lighting device in accordance with a pre-determined time profile which defines the increasing, holding and reducing said lighting intensity;

said lighting control device includes at least two different pre-determined time profiles for increasing, holding and reducing said lighting intensity said lighting control device utilizes one of said pre-determined time profiles depending upon the type of operation leading to the switching on of said lighting device; and at least one function switch operable by a user to initiate a cooking process, said lighting control device utilizing one of said at least two pre-determined time profiles for increasing, holding and reducing said lighting intensity of said cooking area lighting device in connection with a switching on of said at least one function switch, wherein one of said at least two pre-determined time profiles is operatively associated with the respective cooking process selected by the function switch and said lighting control device switches on said lighting device utilizing said one of said at least two pre-determined time profiles in accordance with the respective cooking process selected by the function switch.

2. The baking oven according to claim 1, including said two different pre-determined time profiles have differences in the increasing of said lighting intensity from a minimum value to a maximum value.

3. The baking oven according to claim 1, including said two different pre-determined time profiles have differences in the reducing of said lighting intensity from a maximum value to a minimum value.

4. The baking oven according to claim 1, including said two different pre-determined time profiles have differences in the holding of said lighting intensity.

5. The baking oven according to claim 1, including said two different pre-determined time profiles have differences in the rising ramp of the increase and/or in the falling ramp of the decrease and/or in the value of said lighting intensity in the increased and/or the reduced state.

6. The baking oven according to claim 1, including a door opening signal element providing a signal of the opening of said door to said lighting control device, said door opening signal element can be actuated by at least one of said door position and said door handle which can be actuated manually to open said door.

7. The baking oven according to claim 6, including said lighting control device switches on said lighting device in response to receiving said door opening signal from said door opening signal element which signals an opening of said door and said lighting control device increases said lighting intensity from a minimum value to a maximum value at a fast rate.

8. The baking oven according to claim 6, including said lighting control device distinguishes whether said door opening signal element is actuated manually for a pre-determined long first minimum time period indicating a opening of said door or that said door opening signal element is actuated manually for a pre-determined short second minimum time period indicating that a person wishes to switch on said lighting device without opening said door, said pre-determined long first minimum time period causes said lighting intensity to increase at a fast or very fast rate with a steep rising ramp or abruptly and said lighting intensity is reduced at a slow or very slow rate with a flat falling ramp time profile and said pre-determined short second minimum time period causes said lighting intensity to increase from a minimum value at a moderate or fast rate on a rising ramp or abruptly and then held for a short minimum time period at said maximum value and then said lighting intensity is reduced at a fast rate on a ramp or abruptly from said maximum value to said minimum value.

9. The baking oven according to claim 6, including said door opening signal element of said door handle is a contact sensor which can be actuated by manual contact.

10. The baking oven according to claim 1, including said lighting control device reduces said lighting intensity from a maximum value to a minimum value after a pre-determined holding time period during which said lighting intensity is held to said maximum value after said lighting control device is switched on, said pre-determined holding time period beginning when said maximum value is reached and running automatically if said cooking door is not opened during said holding time period and stopping running if said cooking door is opened during said holding time period and said lighting control device staffing again said holding time period after said door is closed.

11. The baking oven according to claim 10, including said lighting control device reduces said lighting intensity from a maximum value to a minimum value at a very slow or slow rate depending on a lighting intensity time ramp of said time profile.

12. The baking oven according to claim 1, including said time profiles are stored in said lighting control device or can be generated by said lighting control device utilizing a computer program stored therein depending upon the type of operation by which said lighting device is switched on.

13. The baking oven according to claim 1, including at least one of said two different pre-determined time profiles has a lighting intensity time increasing ramp for increasing and/or a lighting intensity time ramp for reducing said lighting intensity.

14. The baking oven according to claim 1, including at least one of said two different pre-determined time profiles has a lighting intensity held at a lower value (max/x) compared with the maximum value (max), which lies above zero, for permanent lighting in said cooking area.

15. A baking oven, comprising:

a cooking area having an opening;

a door having a handle, said door for selectively closing said opening of said cooking area and selectively uncovering said opening of said cooking area, said door being movable between its closing disposition and its uncovering disposition via the application by a person of a manual force on said door handle;

a lighting device for lighting said cooking area with a lighting intensity that varies as a function of a first oven engagement event and as a function of a second oven engagement event, said first oven engagement event being an application by a person of a manual force on said door handle to move said door from its closing disposition into its uncovering disposition and said second oven engagement event being an engagement of the baking oven by a person in a manner that does not include applying a manual force on said door handle to move said door from its closing disposition into its uncovering disposition; and a lighting control device coupled to said lighting device for switching on said lighting device into a switched-on state, holding said lighting device in the switched-on state, and switching off said lighting device in accordance with a first pre-determined time profile associated with said first oven engagement event during which said door is moved from its closing disposition into its uncovering disposition and for switching on said lighting device into its switched-on state, holding said lighting device in the switched-on state, and switching off said lighting device in accordance with a second pre-determined time profile associated with said second oven engagement event with at least one of the increase, the holding, and the reduction of said light intensity in accordance with said first pre-determined time profile being different than a respective one of the increase, the holding, and the reduction of said light intensity in accordance with said second pre-determined time profile at least one function switch by means of which a respective cooking area heating function can be switched on by a person, said second oven engagement event includes a switching on of said at least one function switch by a person, and said second pre-determined time profile is associated with a switching on of said at least one function switch.

* * * * *